United States Patent [19]

Hürlemann

[11] 4,280,392

[45] Jul. 28, 1981

[54] CARTRIDGE FEED APPARATUS FOR AN AUTOMATIC FIRING WEAPON

[75] Inventor: Ernst Hürlemann, Zurich, Switzerland

[73] Assignee: Werkzeugmaschinenfabrik Oerlikon-Bührle AG, Zurich, Switzerland

[21] Appl. No.: 72,101

[22] Filed: Sep. 4, 1979

[30] Foreign Application Priority Data

Sep. 12, 1978 [CH] Switzerland ..... 9532/78

[51] Int. Cl.[3] ..... F41D 10/08

[52] U.S. Cl. ..... 89/33 SF; 89/336

[58] Field of Search ..... 89/33 SF, 33 BB, 33 C

[56] References Cited

U.S. PATENT DOCUMENTS 3,744,371 7/1973 McFarland ..... 89/33 SF

FOREIGN PATENT DOCUMENTS 593539 8/1925 France .
2010995 2/1970 France .
261414 8/1949 Switzerland .
5274 of 1912 United Kingdom .
1256062 12/1971 United Kingdom .

*Primary Examiner*—Stephen C. Bentley
*Attorney, Agent, or Firm*—Werner W. Kleeman

[57] ABSTRACT

A cartridge feed apparatus for two cartridge belts is structured such that the cartridges are infed relatively closely to the lengthwise axis of the weapon barrel, and there can be employed a spring sleeve which is shorter than the stroke of the breechblock head. There are provided respective slides for feeding or forwardly advancing both of the cartridge belts. One of these slides for feeding a cartridge belt and defining a first slide and a further slide defining a second slide during return motion of the spring sleeve, successively engage with the same groove of the spring sleeve. A first transmission element transmits the movement of the first slide to the second slide and a second transmission element transmits the movement of the second slide to the remaining slide defining a third slide.

7 Claims, 6 Drawing Figures

CARTRIDGE FEED APPARATUS FOR AN AUTOMATIC FIRING WEAPON

BACKGROUND OF THE INVENTION

The present invention relates to a new and improved construction of cartridge feed apparatus or system for an automatic firing weapon or gun.

Generally speaking, the cartridge feed system for an automatic firing weapon or gun as contemplated by the invention is of the type comprising two oppositely situated ammunition feeds for the selective infeed of two different ammunition belts to an ammunition infeed location. A feed device is driven by the breech-block of the weapon. This feed device has a groove, inclined to the weapon axis, in a spring or resilient sleeve connected with the breechblock. Further, there is provided a respective slide for each ammunition belt. These slides are operatively connected with feed pawls for moving both of the ammunition belts. One of the slides can be actuated by engagement with such groove.

With a state-of-the-art cartridge feed system of this type, as disclosed in German Patent Publication No. 1,578,427, there is provided a slide for the feed of the cartridge belts. This slide engages in a groove of a spring or resilient sleeve which is connected with the breechblock head. During the return movement of the breechblock head together with the spring sleeve the slide is displaced at right angles to the weapon axis. So that the slide continuously engages with the groove, it is necessary that the spring sleeve have a length amounting to at least that of the stroke of the breechblock head. Such long spring sleeve, which is connected with the breechblock head and therefore participates in the entire stroke of such breechblock head, requires a correspondingly long breechblock housing.

A further drawback of this prior art cartridge feed system resides in the fact that, the slide together with the feed pawls for the cartridges is arranged between the spring sleeve and the cartridge belt. Consequently, the cartridge belt cannot be directly infed adjacent the lengthwise axis of the weapon barrel and there is necessary a pronounced deflection of the cartridges which must be inserted by the breechblock into the weapon barrel.

There is already known a belt indexing device from German Patent No. 1,578,400, which is constructed such that there can be avoided the need for providing a long breechblock housing. However, with this construction the feed of the cartridge belts is accomplished by means of indexing or switching wheels and not by means of feed pawls.

Also, in U.S. Pat. No. 3,447,418 there is known to the art a cartridge infeed apparatus wherein both of the cartridge belts are infed relatively closely to the lengthwise axis of the weapon barrel. In this way there can be avoided any pronounced deflection of the cartridges which must be inserted into the weapon barrel by the breechblock. However, the drive for the feed of the cartridge belts is not accomplished by the returning breechblock head, rather by the recoil or return motion of the entire firing weapon.

SUMMARY OF THE INVENTION

Therefore, with the foregoing in mind it is a primary object of the present invention to provide a new and improved construction of cartridge feed system for an automatic firing weapon or gun which is not associated with the aforementioned drawbacks and limitations of the prior art proposals.

Another and more specific object of the present invention aims at providing a new and improved construction of cartridge feed apparatus wherein, on the one hand, the spring sleeve can be structured to be shorter than the stroke of the breechblock head and also can be designed to be correspondingly shorter than the breechblock housing, and, on the other hand, the cartridge belts can be arranged as closely as possible adjacent the weapon axis, in order to thereby beneficially avoid any pronounced deflection of the cartridges.

Yet a further significant object of the present invention is to devise a new and improved construction of cartridge feed system which is relatively simple in design, extremely reliable in operation, not readily subject to breakdown or malfunction, and requires a minimum of maintenance and servicing.

Now in order to implement these and still further objects of the invention, which will become more readily apparent as the description proceeds, the cartridge feed apparatus of the present development is manifested by the features that there is provided a further slide which can be actuated by engagement in the aforementioned groove. Both of the slides which engage with the groove define first and second slides which are arranged in such a manner that during return movement or recoil of the spring sleeve initially the first slide and then the second slide comes into engagement with the groove. A first transmission element transmits the movement of the first slide to the second slide and a second transmission element transmits the movement of the second slide to a third slide.

The advantages of the inventive cartridge feed apparatus resides essentially in the features that the spring sleeve containing a groove can be structured to be appreciably shorter and lighter than the heretofore known spring sleeves. Consequently, the feed slides equipped with the feed pawls need not be arranged between both of the cartridge belts, rather externally of the belts, so that the feed pawls displace the cartridges towards the weapon barrel and not away from such weapon barrels, with the result that the deflection of the cartridges is facilitated during insertion into the weapon barrel.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
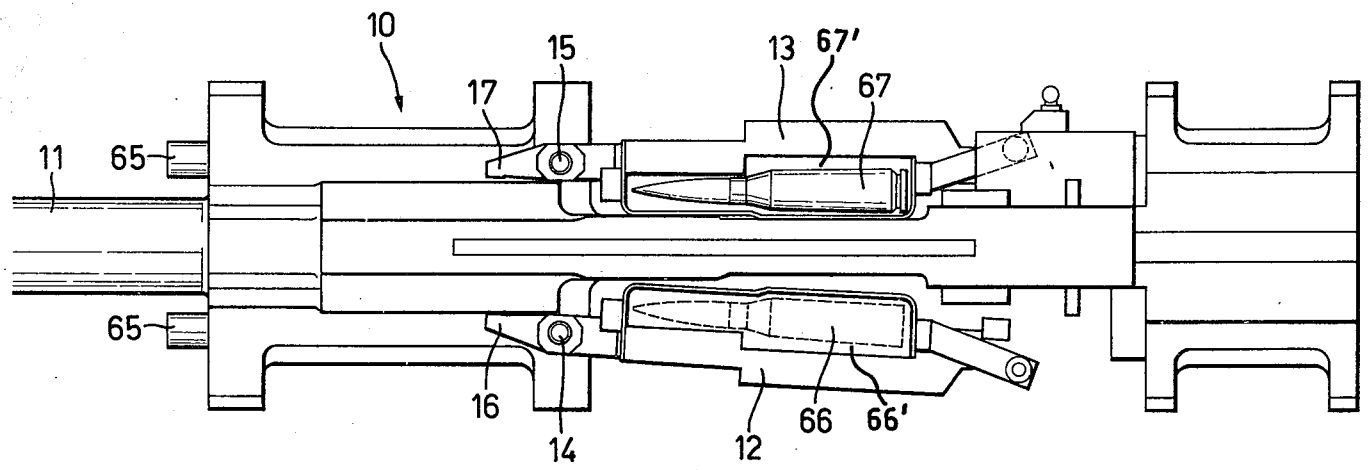
FIG. 1 is a top plan view of the breechblock housing illustrating both of the ammunition guides.

Describing now the drawings, in the showing of FIG. 1 there will be seen that a weapon barrel 11 of an automatic gun or firing weapon is secured at a breechblock housing 10. To both sides of the breechblock housing 10 there are pivotably arranged for movement about the shafts or axes 14 and 15 the two respective ammunition guides or guide means 12 and 13. The pivot shafts or pivot pins 14 and 15 are attached to a stationary gun mount of the weapon which has not been particularly shown in the drawings since details thereof are unnecessary for understanding the inventive concepts and the same may be assumed to be of standard construction. However, the breechblock housing 10 is arranged to be displaceable upon such gun mount, therefore, the stationary pivot pins or shafts 14 and 15 extend through elongate holes 14*a* and 15*a* of the breechblock housing 10, as the same is best recognized by referring to FIG. 4.

Figure 4:
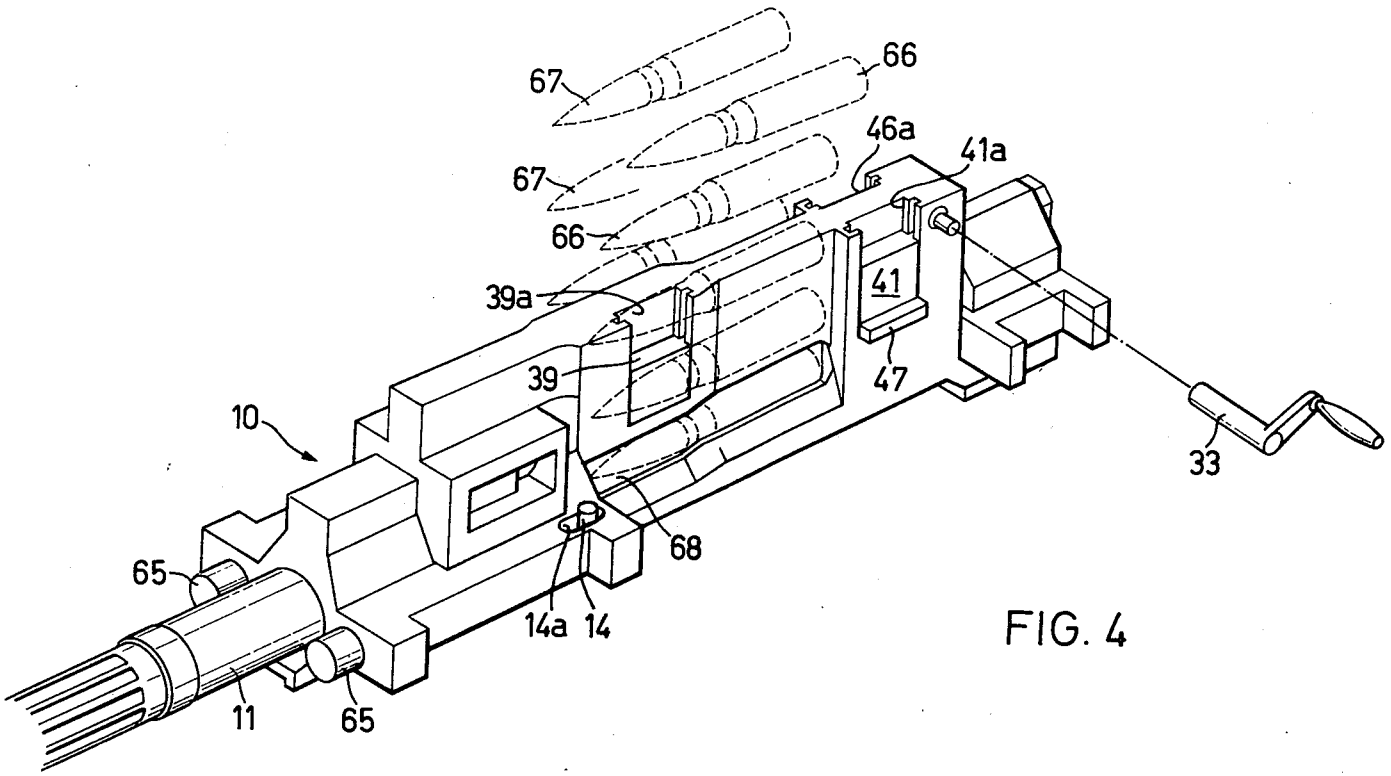
FIG. 4 is a perspective front view of the entire breech-block housing.

As also seen by referring to FIG. 4, arranged within the cylinders 65 are recoil springs which are not particularly visible in the drawings, these recoil springs bearing at their rear ends upon the pins 14 and 15 or equivalent structure. Displacement of the breechblock housing 10 is limited by the length of the elongate holes or bores 14*a* and 15*a*.

Figure 6:
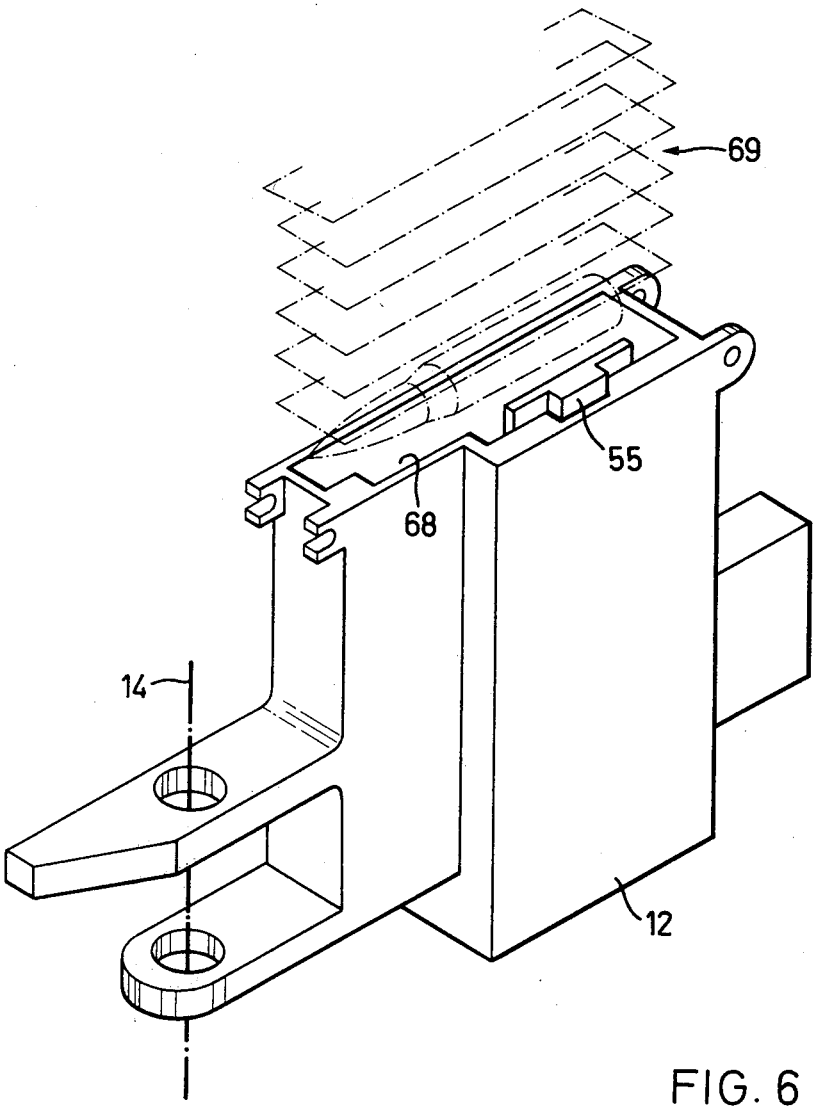
FIG. 6 is a perspective view of the ammunition guide.

The ammunition guide 12 has been shown in FIG. 1 in its rocked-out position, in other words, no cartridges 66 can be infed from this ammunition guide 12 to the weapon. The ammunition guide 13 has been shown in its rocked-in position in the arrangement of FIG. 1, in other words, here it is possible to feed cartridges 67 from such ammunition guide 13 to the weapon. The cartridges 66 and 67 arrive in two essentially parallel rows to both sides of the breechblock housing 10 at a respective ammunition infeed location or inlet opening 68 of the breechblock housing 10, as best seen by referring to FIG. 4. In FIG. 6 there is shown the provision of a flexible channel 69 above the related ammunition guide or guide means, here the ammunition guide 12, by means of which the related cartridge belts, generally indicated in FIG. 1 by reference characters 66' and 67', here specifically the ammunition belt 66' reach the ammunition guide 12 and from that location the inlet opening 68 (FIG. 4).

The pivotal range of both ammunition guides 12 and 13, as shown in FIG. 1, is limited by the stops or impact members 16 and 17.

Figure 2:
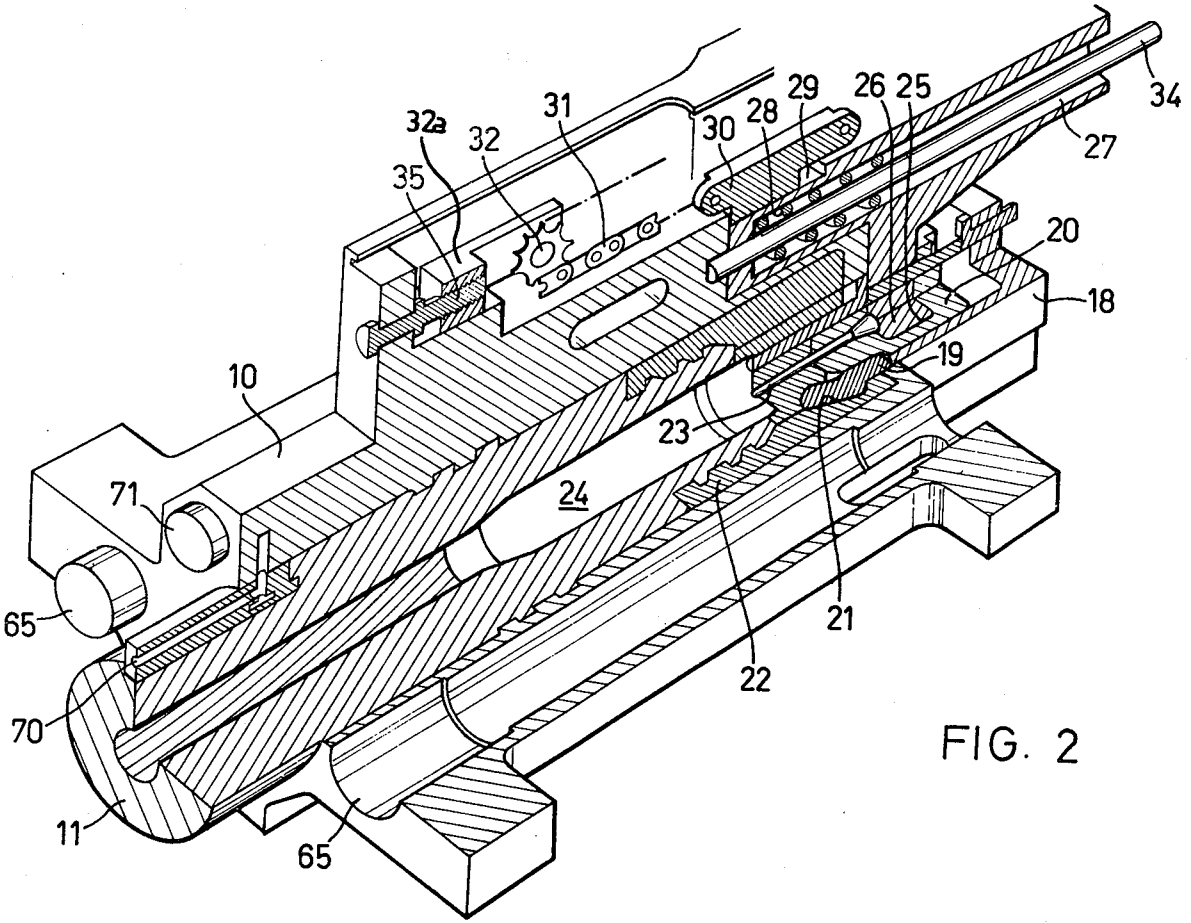
FIG. 2 is a perspective sectional view showing part of the breechblock housing.

According to the illustration of FIG. 2, there is arranged behind the weapon barrel 11 a breechblock head 18 having two breechblock locks 19 conventionally arranged to both sides of the breechblock head 18, there being shown in FIG. 2 only one of the two breechblock locks 19. A control element or piece 20, displaceable in the breechblock head 18, presses, in the illustrated front position, the breechblock lock 19 into recesses 21, with the result that the breechblock head 18 is locked in its forwardmost position. The recess 21 is located in a sleeve 22 which is attached at the weapon barrel 11. At the control element 20 there is secured a firing pin 23 or equivalent structure, which piercingly extends through the breechblock head 18 and serves for firing a cartridge which is located in a cartridge chamber 24 at the rear end of the weapon barrel 11. The control element 20 possesses a recess 25 into which produtrudes the nose of a spring or resilient sleeve 27. Internally of the spring sleeve 27 there is located a guide rod 34, about which there is wound a closure spring 28, which strives to displace the spring sleeve 27 and by means of the nose 26 the control element 20 as well as the breechblock head 18 into the forwardmost position, where the cartridge chamber 24 of the weapon barrel 11 is closed. Engaging into a recess 29 of the spring sleeve 27 is an entrainment member or element 30 which is attached at an endless chain 31 or equivalent structure. This endless chain 31 is guided, essentially parallel to the weapon axis, over two sprocket wheels 32, of which in FIG. 2 there is only visible the forward sprocket wheel 32. A hand crank 33, shown in FIG. 4, engaging at the second sprocket wheel 32 which is not visible in the showing of the drawing, serves to tension closure or breechblock spring 28 and for retraction of the breechblock head 18 out of its forwardmost position, according to the showing of FIG. 2, into its rearmost position which has not been particularly illustrated in the drawings.

A screw 35 or equivalent structure, mounted rotatably but axially non-displaceably in the breechblock housing 10 and threaded into a slide element 32*a* carrying the sprocket wheel 32, serves for tensioning the endless chain 31.

The axis of the weapon barrel 11 and the axis of the guide rod 34, about which there is wound the closure spring 28, and the endless chain 31 are located in a vertical symmetry plane of the weapon. As mentioned, the not particularly illustrated recoil springs are located in the cylinders 65 which have been shown in sectional view in FIG. 2. Further, FIG. 2 shows a gas removal channel 70 leading to a cylinder 71 in which there is located a gas piston 71' (see FIG. 3).

Figure 3:
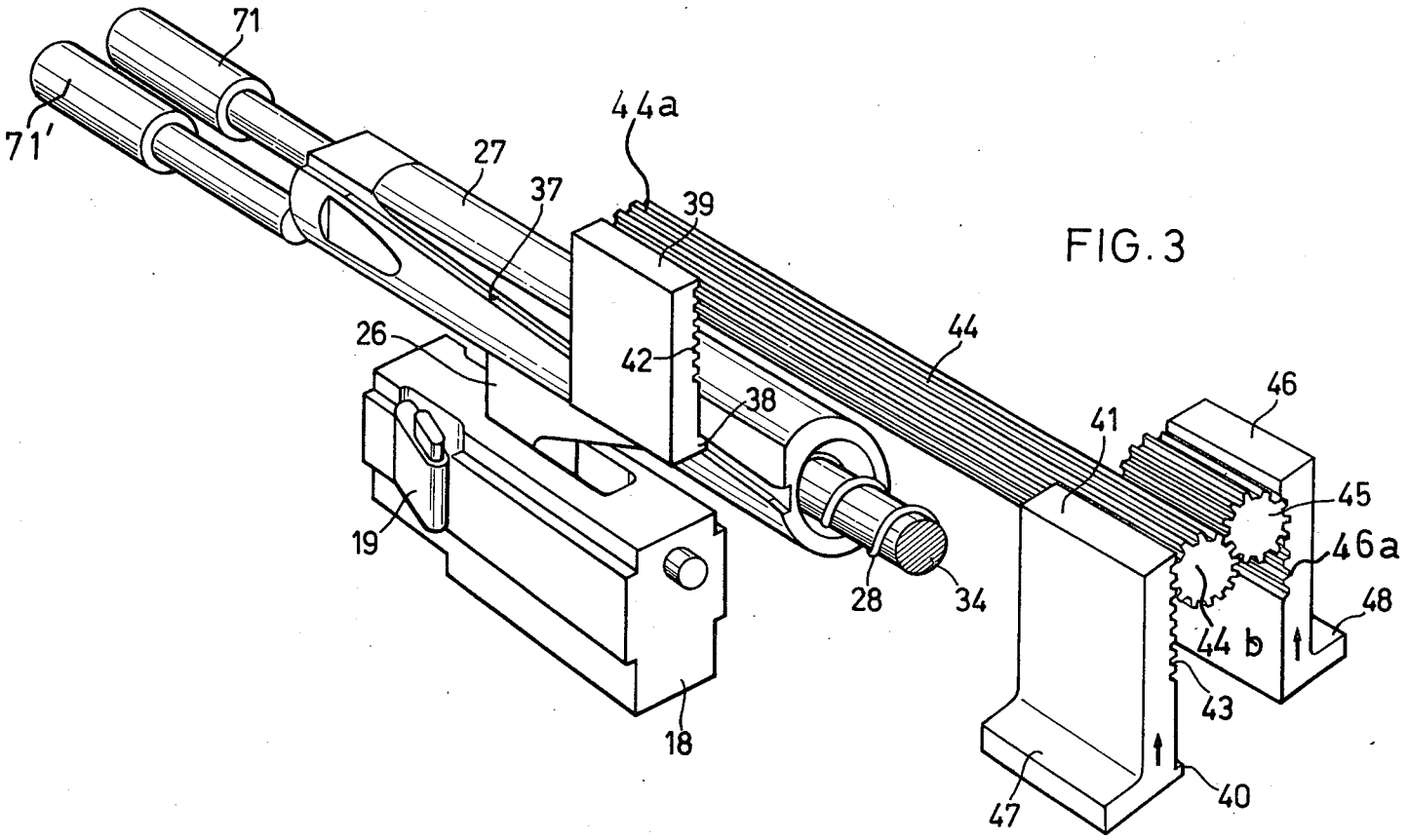
FIG. 3 is a perspective view of the feed apparatus located in the breechblock housing.

According to the showing of FIG. 3, the spring sleeve 27 possesses a groove 37 which is inclined with respect to the weapon axis. Protruding into the groove 37 is a cam or dog 38 of a first slide or slide member 39, as long as the spring sleeve 27 is located in the front portion of its movement path. Engaging also with the groove 37 is a cam or dog 40 of a second slide or slide member 41, as soon as the spring sleeve 27 is located at the rear portion of its movement path or path of travel. Each of the slides 39 and 41 possesses a respective toothed rack 42 and 43 engaging with a bar-shaped gear 44. Instead of providing the bar or rod-shaped gear 44 it would be possible to provide a shaft having at both ends a respective gear 44*a* and 44*b* meshing with the racks 42 and 43 at both slides 39 and 41, respectively, as generally indicated in FIG. 3. The gear 44*a* or the gear 44*b* at the ends of the aforementioned shaft engage with a further gear 45. A third slide 46 engages, by means of a gear rack 46*a*, with this further gear 45. The second and third slides or slide members 41 and 46 each are provided with a flange 47 and 48, respectively.

According to the showing of FIG. 4 these three slides or slide members 39, 41 and 46 are guided, within the breechblock housing 10, in recesses or channels 39*a*, 41*a* and 46*a*, respectively. Between both of the slides or slide members 39 and 41 there is arranged relatively narrowly the breechblock housing 10, and the cartridges 66 and 67, infed to both sides of the breechblock housing 10, can be arranged closely adjacent one another and near to the weapon axis. The spacing of both cartridges 66 and 67 and their related cartridge belts from one another can be particularly well seen from the showing of FIG. 1.

Figure 5:
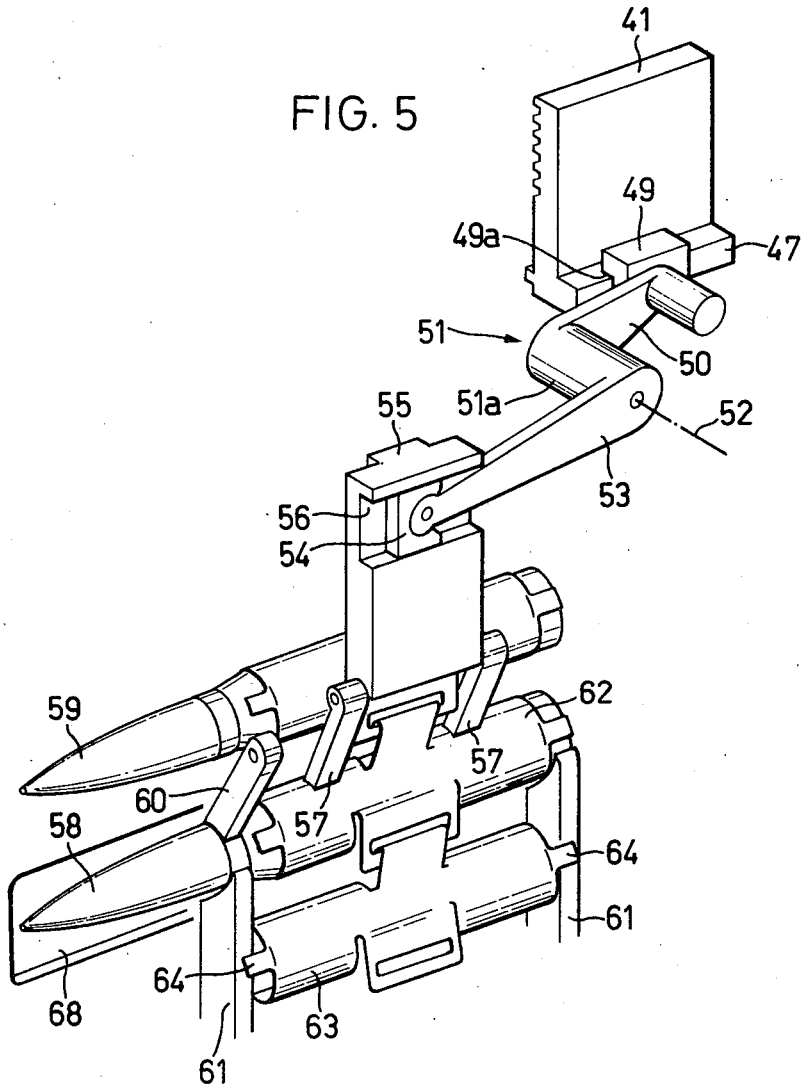
FIG. 5 is a perspective view of the feed apparatus located in the ammunition guide.

According to the showing of FIG. 5, a slide element 49 is provided with a groove 49*a* into which protrudes the flange 47 of the second slide or slide member 41. This slide element 49 is hingedly connected with an arm 50 of a double-arm lever 51. This double-arm lever 51 has a sleeve 51*a* at which there are attached the two arms 50 and 53 of the lever 51. The double-arm lever is pivotably mounted about its axis 52 in the ammunition guide or guide means 12 (FIG. 1). A mirror-image constructed double-arm lever is pivotably mounted in the other ammunition guide or guide means 13, but since this other double-arm lever does not differ in structure from the illustrated double-arm lever 51 it is not here further shown. At the second arm 53 there is hingedly connected a further slide element or block 54 which is guided in a groove 56 of a feed slide 55. This feed slide 55, as best seen by referring to FIG. 6, is displaceably arranged in the ammunition guide 12. A similar, not particularly illustrated feed slide is displaceably arranged in the other ammunition guide or guide means 13. Both of the feed slides each have two respective feed pawls 57, as best seen by referring to FIG. 5, which bear upon a cartridge 58. A not particularly illustrated spring strives to press both of the feed pawls 57 against the cartridge 58. The feed slide 55 is located, in the showing of FIG. 5, in its lowermost position, and the cartridge 58 is in its infeed or insertion position 68 of the breechblock housing 10 where it can be inserted, by the breechblock head 18 (FIG. 2), into the cartridge chamber 24 of the weapon barrel 11. With the aid of the double-arm lever 51 the feed slide 55 can be raised to such an extent that both of the feed pawls 57 can bear upon the next following cartridge 59. A pawl 60, pivotably mounted in the ammunition guide 12, is assigned the task of preventing that the ammunition belt together with the cartridges 58 and 59 will move back when the feed slide 55 together with the feed pawls 57 are raised, in order to engage the cartridge 59. A not particularly shown, but conventional spring serves the purpose of pressing the pawl 60 against the cartridge 58.

The cartridge 58 bears upon two rails 61, by means of which the cartridges 58 are guided through the inlet opening 68 towards the weapon axis. The rails 61 additionally serve for stripping the belt element or link 62 from the cartridge 58. The preceding belt element or link 63 has already been stripped by the preceding cartridge which has not been shown in the drawing but already introduced into the cartridge chamber 24 of the weapon barrel. The belt link or element 62 has two noses 64, by means of which it bears upon the rails 61. The belt link or element 62, during the displacement of the cartridge 58 into the chamber 24 of the weapon barrel 11, is stripped by the forwardly moving breechblock head 18 from the cartridge 58.

The apparatus for pivoting both of the ammunition guides 12 and 13 into their work and rest position, as the case may be, is of known construction and therefore here not further shown since it does not form part of the subject matter of the present invention.

As already explained both of the ammunition guides 12 and 13 are rotatably mounted about the stationary shafts or pins 14 and 15 of the gun mount whereas the breechblock housing is arranged to be rearwardly mobile upon the gun mount and bears by means of recoil springs at the pins 14 and 15. By virtue of this arrangement the second slide 41 and the third slide 46 (FIG. 3) which are arranged in the breechblock housing 10, can be displaced in relation to the double-arm levers 51 which are mounted in both of the ammunition guides 12 and 13. Therefore, it is important that the flanges 47 and 48 of both slides 41 and 46, guided in the grooves **49*a* of the slide elements 49, are of sufficient length so that they cannot slide out of the grooves 49*a***.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A cartridge infeed apparatus for an automatic firing weapon, comprising:

two oppositely situated ammunition guide means for the selective infeed of two different ammunition belts to an ammunition infeed location;

a feed device capable of being driven by the breechblock of the firing weapon;

said feed device having a spring sleeve operatively connected with the breechblock;

said spring sleeve having a groove which is inclined with respect to the lengthwise axis of the firing weapon;

said feed device further including: a respective slide for each ammunition belt; feed pawl means with which each slide is operatively connected for moving both of the ammunition belts;

one of said slides being actuated by engagement with said groove and defining a first slide;

an additional slide defining a second slide and actuatable by engagement with said groove;

both of said first and second slides which can engage with said groove being arranged such that upon return movement of the spring sleeve initially the first slide and then the second slide comes into engagement with said groove;

the remaining one of said slides defining a third slide;

a first transmission element for transmitting the movement of the first slide to the second slide; and a second transmission element for transmitting the movement of the second slide to the third slide.

2. The cartridge feed apparatus as defined in claim 1, wherein:

said first transmission element comprises two rigidly interconnected gears;

a gear rack provided for the first slide;

a gear rack provided for the second slide;

one of the gears meshing with the gear rack of the first slide; and the second gear meshing with the gear rack of the second slide.

3. The cartridge feed apparatus as defined in claim 2, wherein:

said second transmission element comprises a third gear;

a gear rack provided for the third slide; and the third gear meshing with the second gear and with the gear rack of the third slide.

4. The cartridge feed apparatus as defined in claim 3, further including:

a breechblock housing having three different, essentially mutually parallel grooves;

said three slides being displaceably guided in said three mutually parallel grooves of the breechblock housing;

means for rotatably mounting said three gears in the breechblock housing; and said three gears having their axes of rotation extending parallel to the lengthwise axis of the firing weapon.

5. The cartridge feed apparatus as defined in claim 1, wherein said feed device further includes:

a respective double-arm lever pivotably mounted in the ammunition guide means;

a respective feed slide provided with feed pawls displaceably guided in groove means of the ammunition guide means at right angles to the lengthwise axis of the weapon; and said second and third slides being operatively connected by means of the respective double-arm levers with their related feed slide.

6. The cartridge feed apparatus as defined in claim 5, wherein:

each said double-arm lever has a first arm and a second arm;

a respective slide element with which there is operatively connected the first arm of the related double-arm lever;

each said slide element having a groove;

said second and third slides having flange means;

said flange means engaging with said groove of said slide element;

a further slide element of the related double-arm lever provided for each double-arm lever;

said second arm of the related double-arm lever being pivotably connected with said further slide element;

said further slide element engaging into a groove of the related feed slide; and both of said arms of each said double-arm lever being secured to a sleeve which is pivotably mounted about a pivot axis in the related ammunition guide means.

7. The cartridge feed apparatus as defined in claim 1, wherein:

both of the ammunition belts are arranged essentially parallel to one another;

said breechblock including a breechblock housing;

the second and third slides being arranged upon the said breechblock housing which is located between both of said ammunition belts; and said feed device further including a pair of feed slides cooperating with said second and third slides and arranged at sides of the ammunition belts which are situated opposite the breechblock housing, in order that the spacing between both of the ammunition belts is relatively small.

* * * * *